United States Patent [19]

Bono

[11] Patent Number: 4,706,779

[45] Date of Patent: Nov. 17, 1987

[54] TRANSPORTABLE, TWIN TELESCOPIC ARM PLATFORM HOIST

[76] Inventor: Francesco Bono, S.S. 22, no. 16, San Rocco di Bernezzo (Cuneo), Italy

[21] Appl. No.: 900,706

[22] Filed: Aug. 27, 1986

[30] Foreign Application Priority Data

Sep. 2, 1985 [IT] Italy ..... 67746 A/85

[51] Int. Cl.[4] ..... B66B 9/20

[52] U.S. Cl. ..... 182/63; 182/103; 182/145

[58] Field of Search ..... 182/103, 102, 101, 63–67, 182/141, 142, 145, 146; 187/10, 11, 9 E

[56] References Cited

U.S. PATENT DOCUMENTS

| | | | |
|---|---|---|---|
| 2,241,275 | 5/1941 | Shinn | 182/103 |
| 3,666,054 | 5/1972 | Ellings | 182/103 |
| 3,891,062 | 6/1975 | Geneste | 182/103 |
| 3,908,801 | 9/1975 | Pohlman | 182/103 |
| 3,921,758 | 11/1975 | Kozai | 182/103 |
| 4,031,980 | 6/1977 | Terayama | 182/103 |
| 4,183,423 | 1/1980 | Lewis | 182/103 |
| 4,491,196 | 1/1985 | Bocker | 187/10 |
| 4,546,853 | 10/1985 | Hanson | 182/103 |
| 4,546,854 | 10/1985 | Bocker | 187/10 |

*Primary Examiner*—Reinaldo P. Machado

*Attorney, Agent, or Firm*—Harry M. Weiss & Associates

[57] ABSTRACT

The present invention is a transportable hoist consisting of a twin-arm telescopic unit comprising a given number of rectangular telescopic elements, which can be extended longitudinally by means of a telescopic hydraulic cylinder. A carriage with a work platform is mounted on said twin-arm unit; the carriage and work platform are moved along the unit by means of two steel cables connected to a windlass. The carriage is equipped with an automatic emergency brake. The twin-arm unit is supported by a pivoting platform mounted on a self-propelled or towed vehicle. Two telescopic cylinders are used to set the angle of said unit during use.

9 Claims, 16 Drawing Figures

200
109
150
108
150
107
142
106
143
141
142
140
X
X
105...105a 112
137
137
200
109
109a
111
108a
108
111
119
123
120
107
107a
111
106a
106
B
111
105a
105
201
103
104
114
102
101
121
118
A
110
113
116
117
115
122

Fig. 3
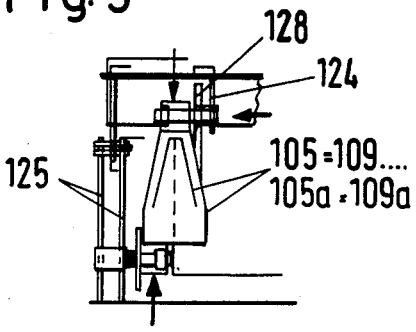
Fig. 4
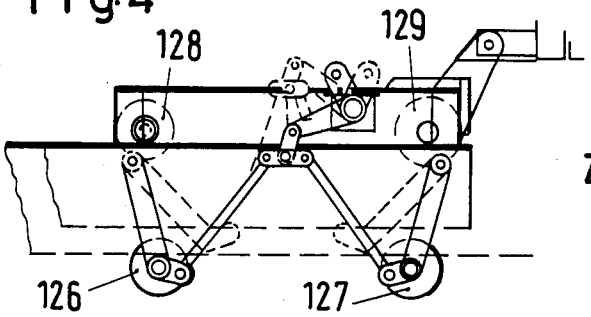
Fig. 5
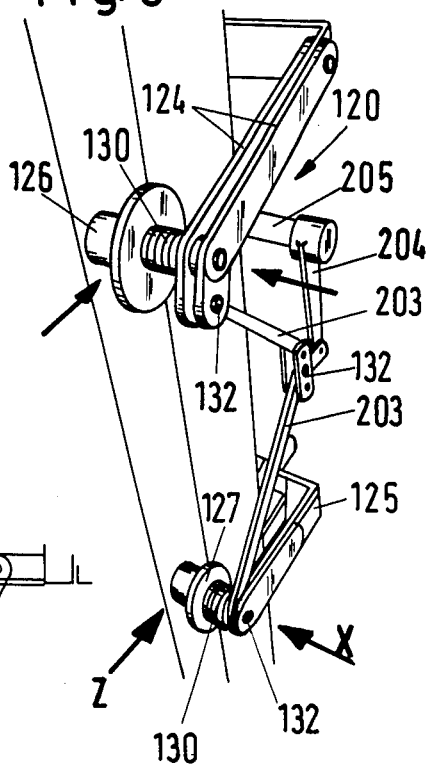
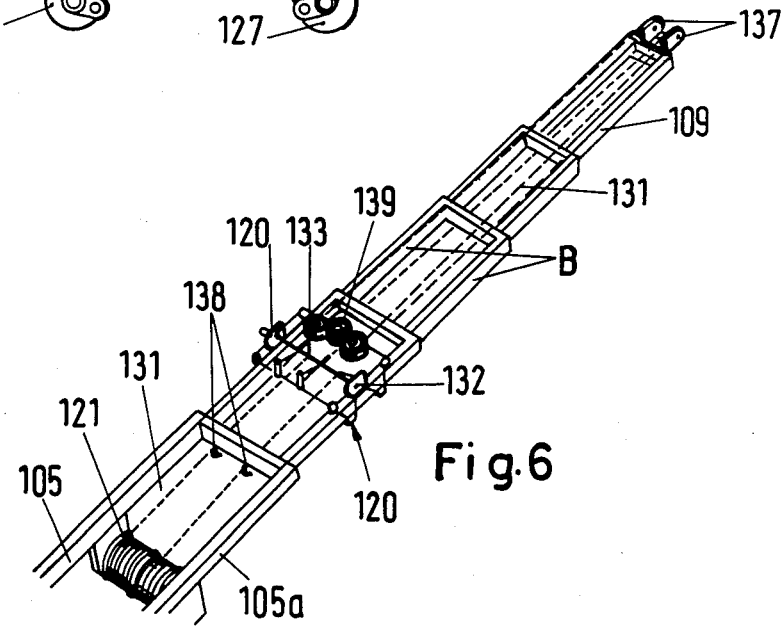
Fig. 6

FIG.7
FIG.7B
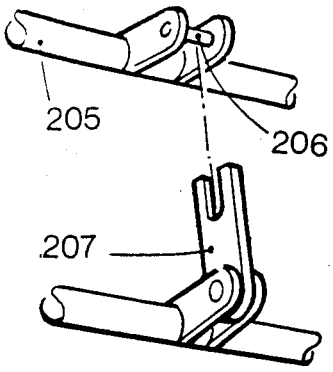
FIG.7A
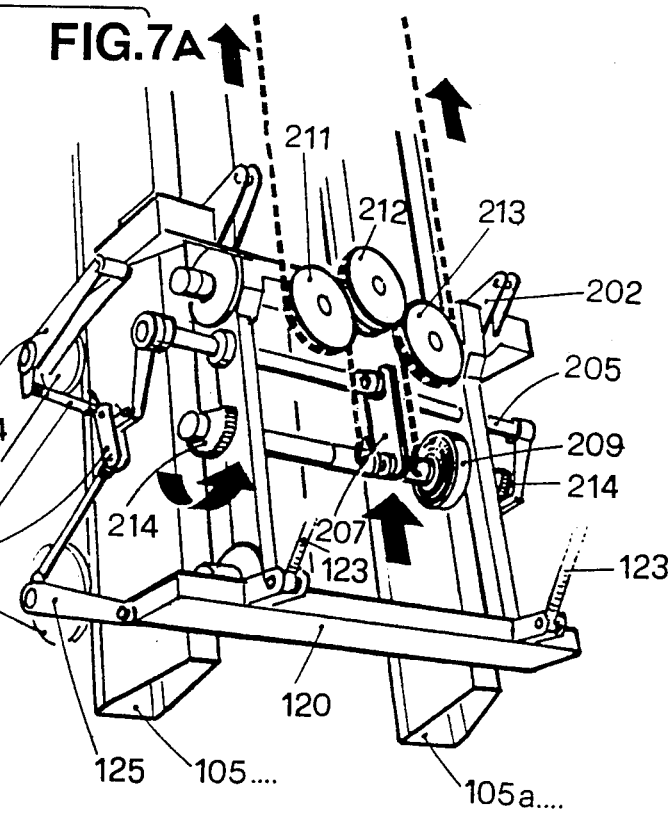
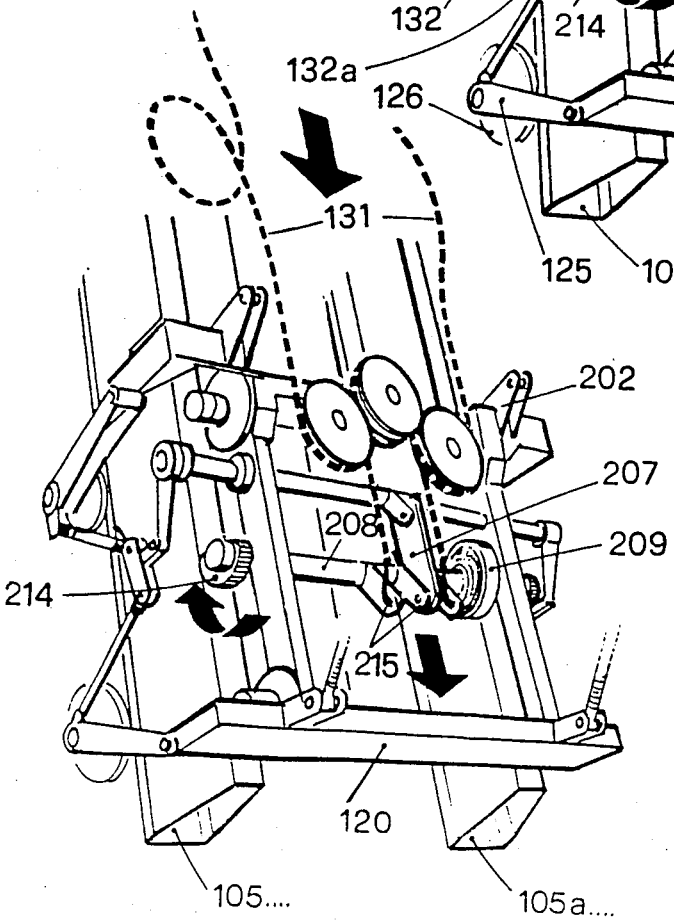
FIG.8

Fig.10
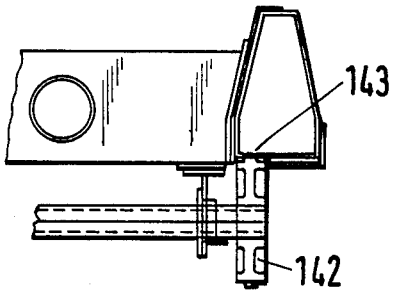
Fig.11
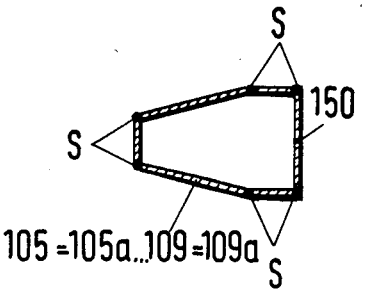
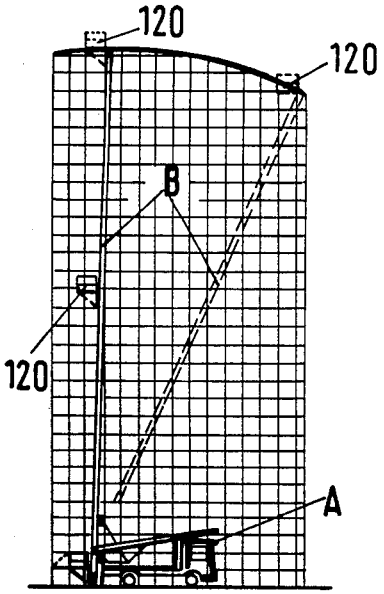
Fig.12
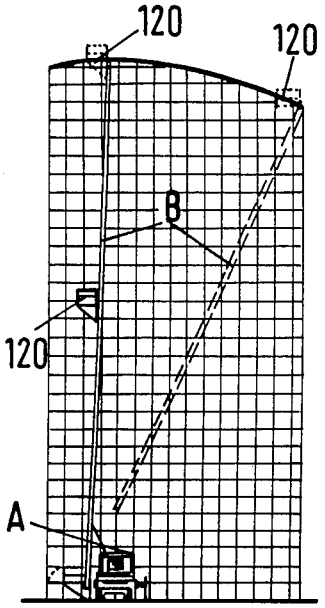
Fig.13

TRANSPORTABLE, TWIN TELESCOPIC ARM PLATFORM HOIST

DESCRIPTION

The same applicant holds Italian patent No. 67746-A/85 for a hoist consisting of a twin-arm telescopic unit with a pivoting base that can be installed on different types of vehicles. A carriage equipped with a work platform, capable of transporting men or loads to considerable heights, is mounted on said twin-arm unit; said carriage is connected to a steel cable, which in turn is connected to a windlass. A motor independent of the vehicle's engine operates the windlass and the angular movement of the pivoting platform. A single-action, telescopic hydraulic cylinder extends or retracts the telescopic elements; two hydraulic cylinders attached at the pivoting platform and at the first two elements of the twin-arm telescopic unit are used to set the angle of said unit during use. The work platform connected to the carriage is equipped with an automatic emergency brake.

As a result of the practical use of this hoisting machine according to the above mentioned patent, a series of improvements to the principal components of said machine have been made. The main improvements regard the carriage and work platform, the carriage emergency brake, and the cable system for operating said carriage along the twin-arm telescopic unit.

These improvements, which are the purpose of this invention, consists of the following:

The carriage and platform have four pairs of symmetrical rollers; the two rollers making up each pair of rollers are located on either side of the twin telescopic arm. Said rollers, having a frustoconical profile, continuously adhere to the parallel surfaces and exterior sides of the two telescopic rails; said rollers are connected to rocker arms enabling them to conform to the variable cross section of the telescopic elements thanks to the traction of the carriage and the force exerted by elastic devices described below.

An emergency brake is automatically activated by means of the reaction of a sturdy coil spring if both pull ropes break.

The rope drive system consists of two steel ropes connected to a windlass with an incorporated brake.

The hoisting machine has a second windlass with an incorporated brake to pressurize a telescopic hydraulic cylinder.

The invention will be described further, by way of example, with reference to the accompanying drawings, in which:

FIG. 3 is a schematic, cross section of one of the two telescopic elements showing part of the carriage without the platform;

FIG. 4 is a side view of the components shown in FIG. 3;

FIG. 5 is a view in perspective from below of the components shown in FIGS. 2 and 3;

FIG. 6 is a view in perspective of the partially extended twin-arm telescopic unit also showing the windlass used for maneuvering the carriage;

FIGS. 7 and 8 are views in perspective of the carriage without the platform;

FIG. 10 is the cross section of one of the telescopic elements at line X—X shown in FIG. 2;

FIG. 11 is the cross section of one of the elements making up both rails of the twin-arm telescopic unit;

FIG. 12 illustrates the range of the working area of the hoisting machine with respect to the longitudinal axis of the vehicle on which said machine is mounted;

FIG. 13 illustrates the range of the working area of the hoisting machine with respect to the lateral axis of the same vehicle;

Figures 1, 2:
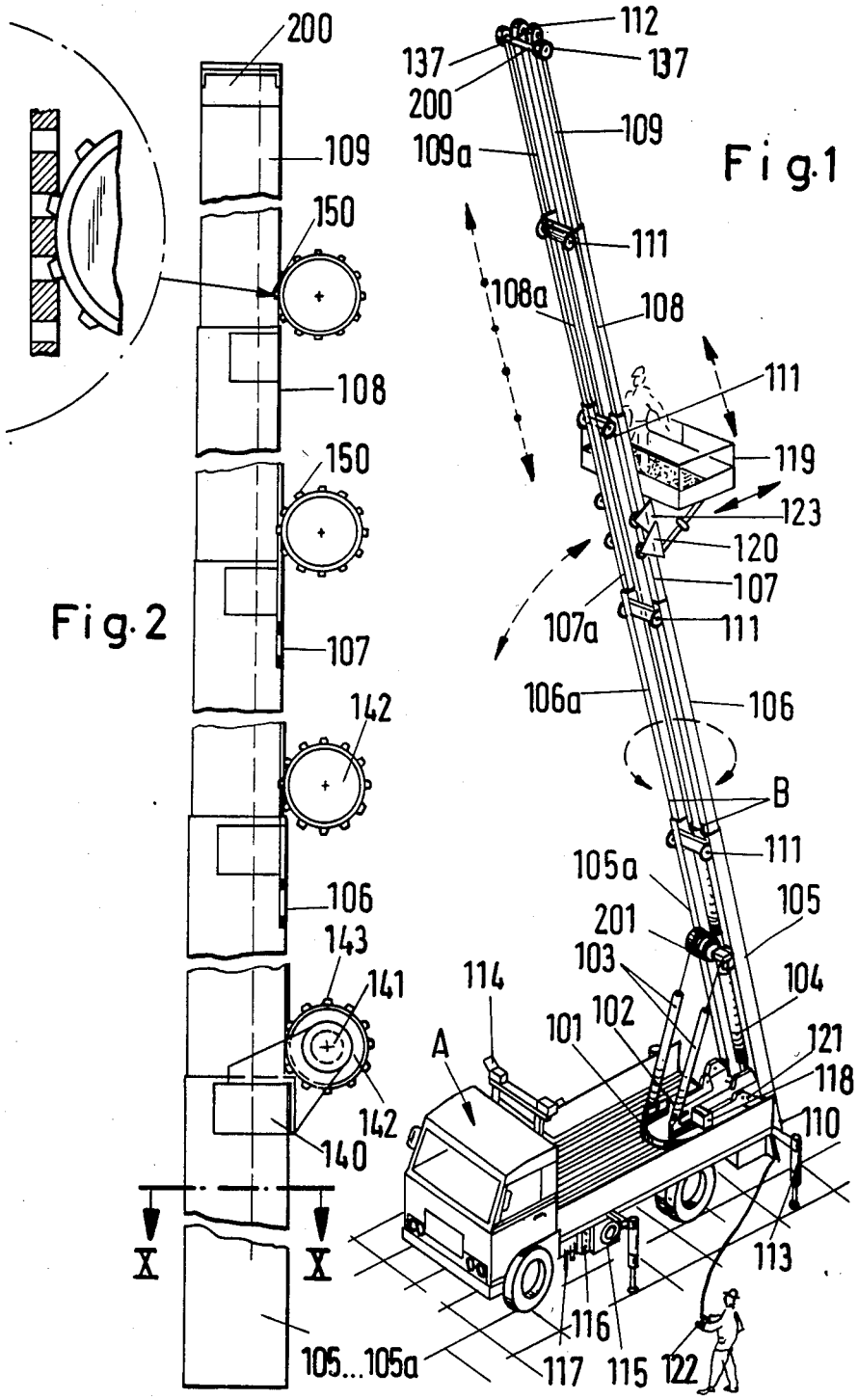
FIG. 1 is an isometric view of the complete hoisting machine in the operative position mounted on a truck.
FIG. 2 is schematic, longitudinal cross section on a different scale of one of the two telescopic elements.
Figure 9:
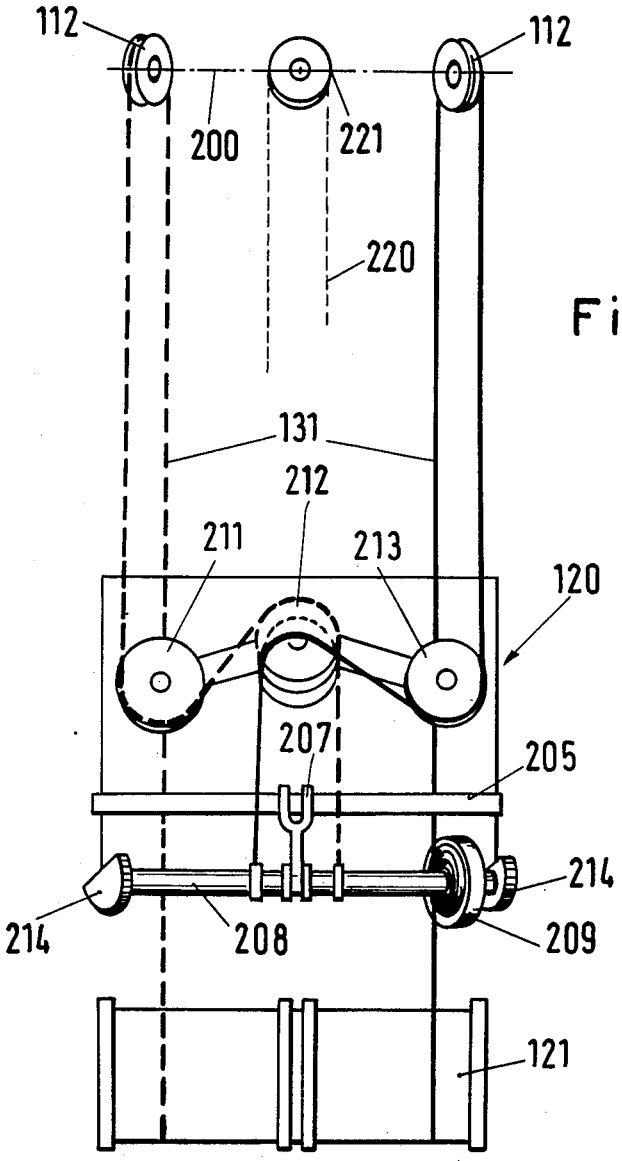
FIG. 9 is a schematic, plan view of the rope drive system used for maneuvering the carriage.

With reference to FIGS. 1 and 2, pivoting platform 101, able to rotate more than 360°, is operated by hydraulic motor 102 with an incorporating brake; said pivoting platform is mounted on the bed of vehicle -A-. A pair of hydraulic cylinders (103) are fixed to the pivoting platform 101; the ends of the pistons of said cylinders are individually fixed to tubular elements 105 and 105*a*, whose base is also fixed to pivoting platform 101 constituting the first section of the twin-arm telescopic unit.

The other elements (106 and 106*a*, 107 and 107*a*, 108 and 108*a*, 109 and 109*a*) are all tubular having a cross section whose geometrical configuration is identical to elements 105 and 105*a*. All the elements are made of steel and have the cross section shown in FIGS. 3 and 11 for the purpose of creating six (6) longitudinal corners, indicated by -S- in FIG. 11 improving the flexural strength of the entire telescopic unit -B-, when in the extended position with a load (FIG. 1).

A hydraulic cylinder 104 with a telescopic piston is fixed at the center of a steel bridge 200 joining the two free ends of telescopic elements 109 and 109*a*. Two small rubber wheels 112 are used for resting the ends of arm -B- against window sills or balconies.

Carriage 120, supporting platform 119 is mounted on arm -B-; said platform includes sides hinged at its base; said sides swing 90° towards the outside of the platform until reaching a position coplanar to the platform's surface in order to facilitate manual loading operations.

Four corner jacks 113 (FIG. 1) have the purpose of stabilizing the bed of the vehicle; 114 indicates a saddle used for resting arm -B- when in the fully retracted position with carriage 120 and platform 119 lowered to a position above elements 105 and 105*a*. A motor 115 used to extend hydraulic cylinder 104 is connected to a transmission 116. A hydraulic control module 118 is connected to the hoist controls located on vehicle -A-. As previously described, there are two windlasses 121 and 201, both with incorporated brakes. The hoist is also equipped with a remote control 122, in addition to manual controls and a radio remote control unit.

CARRIAGE 120 AND PLATFORM 119

Figure 14:
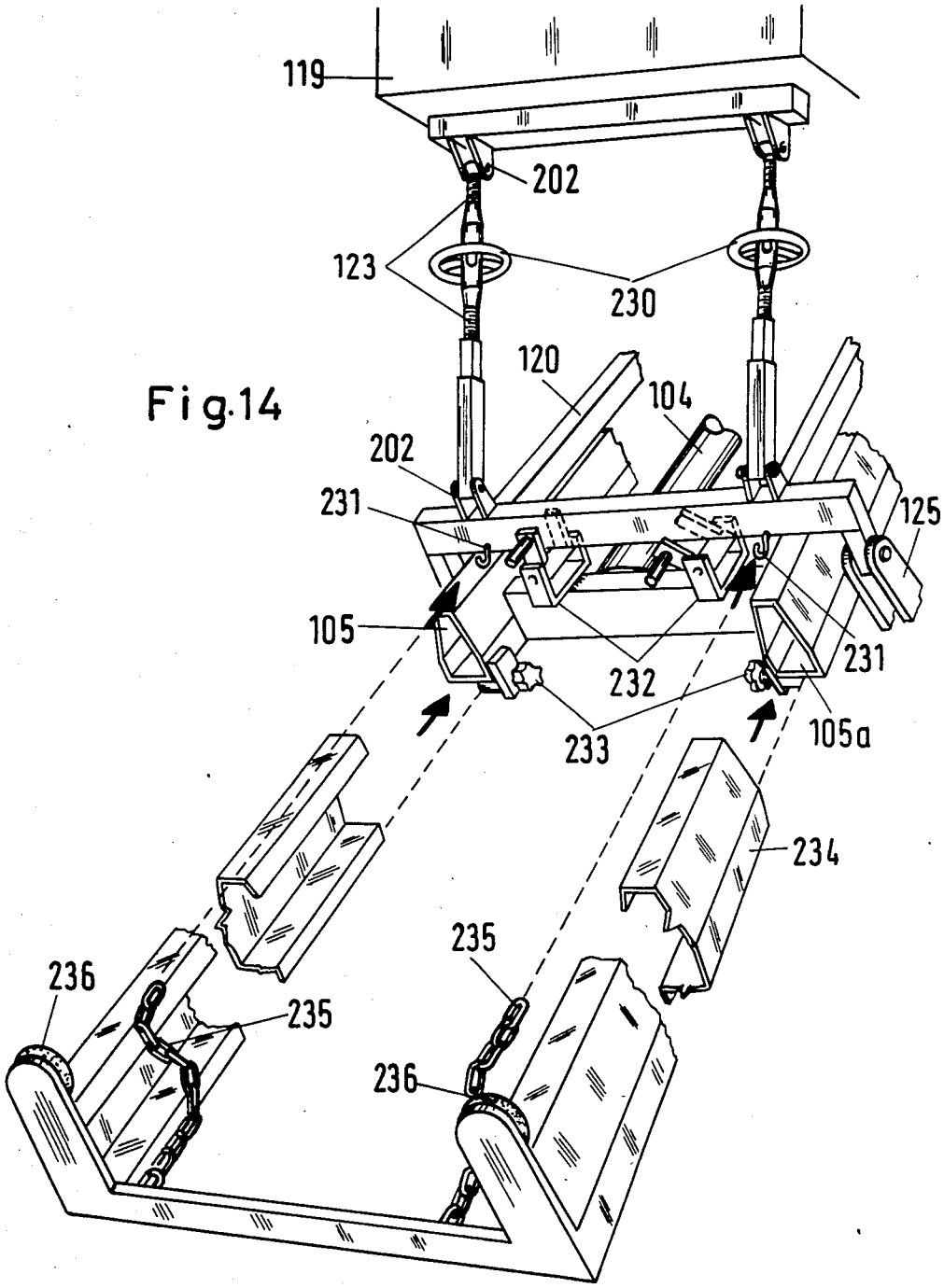
FIG. 14 shows a view of the lower part of the twin-arm telescopic unit on a larger scale.

Carriage 120 (FIGS. 7, 8, 14) supports platform 119; saie platform is articulated in the front at brackets 202 part of the carriage frame, and articulated at the rear by means of right/left threaded bolts 123 used to adjust the height of the platform. Bolts 123 can be replaced by any and all equivalent devices such as hydraulic or pneumatic cylinders, or other mechanisms. The sides of the carriage frame 120 have symmetric, articulated arms 124 and 125 (FIGS. 3, 4, 5), at the ends of which are mounted flanged, frustoconical rollers tangent to the lower surface and outer sides of the two corresponding telescopic elements. Analogous rollers 128 and 129 are mounted on arms (FIGS. 3 and 4) and are tangent to the lower surface and outer sides of the same two corresponding telescopic elements. The rollers 128 and 129 are mounted on fixed shafts so that they can rotate freely, but cannot move axially; the other pair of upper rollers and the two pairs of lower rollers are mounted on corresponding shafts between coil springs 130; said springs exert pressure against the flange of each roller and the part of the carriage where the shaft is fixed; said rollers are idler rollers. All the shafts of the four pairs of rollers may be equipped with springs 130. Levers 124 and 125 are articulated at 132 with stays 203, which in turn are articulated at **132*a* with symmetrical arms 204 located on the sides of carriage 120. Arms 204 are connected to a transverse rod 205 (FIGS. 7 and 8), which turns on its axis and with respect to the frame of said carriage; said transverse rod is equipped with a bracket and pin 206, the center of which engages forked lever 207; said lever is articulated with rod 208, parallel to rod 205, which rotates with respect to carriage 120. Spiral spring 209 is mounted coaxial to rod 208; said spring is wound and fixed to the frame of the carriage exerting force in the direction shown by the arrows in FIG. 8**.

The continuous adherence of rollers 126 and 127 to the rolling surface of the corresponding telescopic elements is assured by the action of steel ropes 131 (FIGS. 6, 7, 8); one end of said ropes are fixed to the brackets on rod 208. The opposite end of said ropes are attached via drive pulleys 211, 212, and 213 on the carriage and pulleys 137, located at the top of twin-arms -B- of the telescopic elements to windlass 121 (FIGS. 1, 6).

COGGED WHEELS HAVING THE PURPOSE OF SYNCHRONIZING THE MOVEMENT OF THE TELESCOPIC ELEMENTS

With reference to FIGS. 2 and 10, a shelf 140 is located at the top of each telescopic element of arm -B-; the symmetric shelves of each telescopic element supports a rotating shaft 141; a pair of cogged wheels 142 are integral with said rotating shaft 141. Said pair of cogged wheels are supported by shelf 140 (FIG. 2), integral with the base telescopic elements 105 and **105*a*, and positioned so that teeth 143 engage notches 150 in the surface of said elements 105 and 105*a*, which face said cogged wheels. All the other telescopic elements of arm -B- are designed in the same manner, except terminal elements 109 and 109*a* having wheels 112, or other equivalent devices, used for resting the twin-arm telescopic unit. The distance between successive teeth of each wheel 142 and the distance between notches is such that the pair of symmetric teeth of each pair of cogged wheels begin to engage the next notch before the pair of teeth preceding them are completely free of the notch in which they are engaged. This configuration has the purpose of creating a sequential, continuous meshing avoiding slippage between the telescopic elements. Pairs of cogged wheels 142** mesh with the telescopic elements assuring a smooth, synchronized longitudinal movement of said elements, both during extension and retraction of twin-arm telescopic unit -B- avoiding jamming.

SECOND WINDLASS

In accordance with the improvement of the hoisting machine, said machine is equipped with a second windlass 201 (FIG. 1) which winds and pays out a steel rope 220, one end of which is attached to the drum of the windlass, passes through pulley 221, and is then fixed to the base of the machine.

Two sliding extensions 234 are mounted on elements 105 and **105*a* of twin-arm telescopic unit -B- (FIG. 14**) for the purpose described below.

MACHINE OPERATION

After vehicle -A- has been positioned where the hoisting machine will be used, two hydraulic cylinders 103 are activated to set the angle of twin-arm telescopic unit -B-. The drums of the two windlasses 121 and 201 are released in order to wind ropes 131 and 220 without moving carriage 120 and work platform as pivoting grips 232 (FIG. 14) are attached to the rear cross member of carriage 120. Cylinder 104 is activated extending arm -B- smoothly thanks to the presence of cogged wheels 142; the twin-arm telescopic unit can be stopped at any height between the maximum and minimum. Once the desired height is reached, windlass 201 is locked and hydraulic cylinder 104 is pressurized. Finally, windlass 121, which moves carriage 120, is activated transporting said carriage and platform 119 to the desired height. The stability of twin-arm telescopic unit -B- under loaded conditions is guaranteed by the tension created by hydraulic cylinder 104 against the reaction of rope 220 and windlass 201.

It is important to note that both upper ends of arm -B- contain electric sensors allowing the electric motor to activate windlass 121 only when said upper ends are resting against a fixed object. If only one of the two ends of said arm are not resting against said fixed object, windlass 121 cannot be activated.

During loading and unloading of platform 119 in the lowered position, extensions 234 are in the extended position; when the machine is not being used, said extensions are retracted along elements 105 and **105*a* and are held in place by setscrews 233 and chains 235, which engage hooks 231**.

Figure 15:
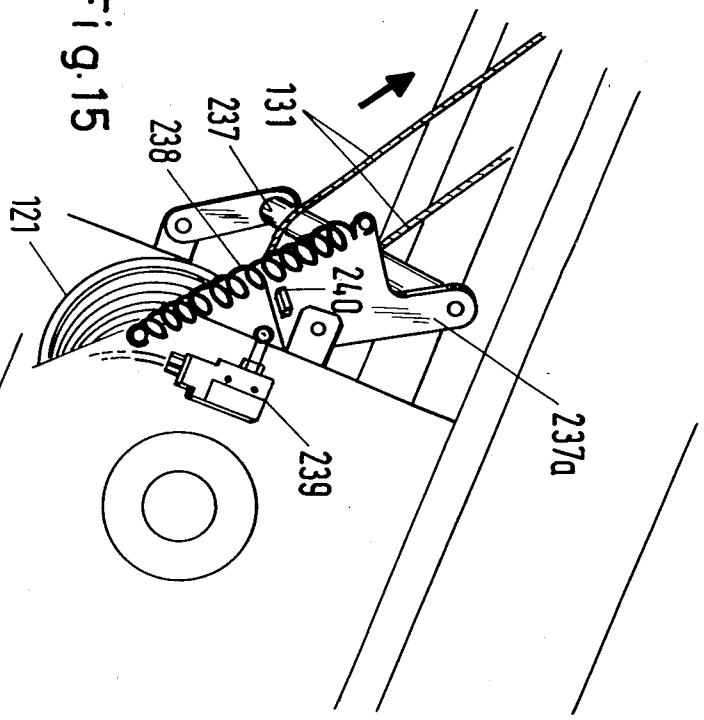
FIGS. 15 and 16 are two views of the device which monitors the tension of the pull ropes.
Figure 16:
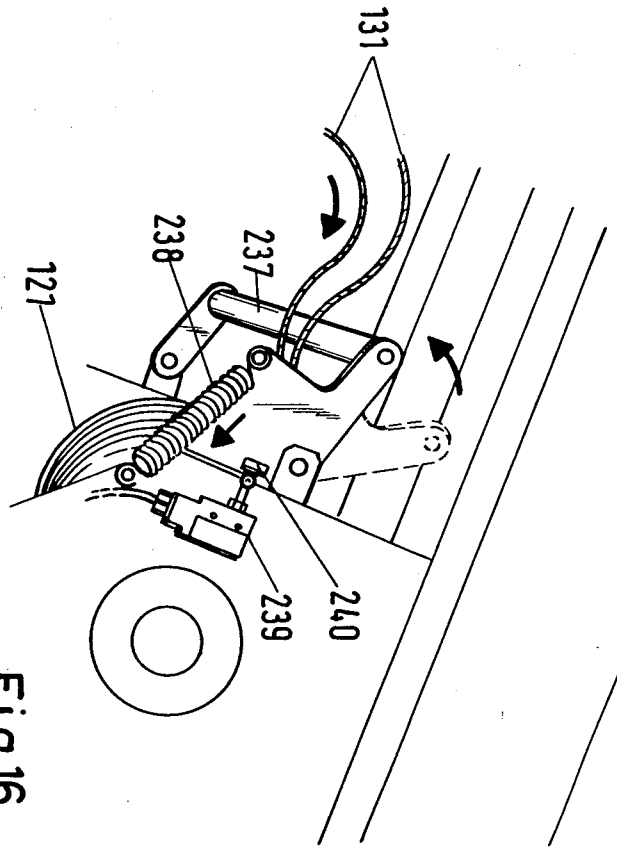

With reference to FIGS. 15 and 16, steel ropes 131 run, with a minimum of angular movement, along the outside of bar 237 supported by a pivoting mechanism **237*a*, preferably positioned near windlass 121. Said mechanism 237*a* is held under tension by spring 238, while the force exerted by the ropes acts in the opposite direction. If there is any slack in said ropes for any reason whatsoever, spring 238 retracts mechanism 237*a* to the position shown in FIG. 16 causing tooth 240 to trip switch 239 connected to a solenoid valve, instantly draining the hydraulic fluid flowing into cylinder 104** and completely stopping all movement of the hoisting machine.

The structural characteristics of the machine, its versatility, and reliability make it suitable for numerous uses. In addition to loading and unloading, the hoist can be used for the emergency evacuation of people and objects from the upper floors of tall buildings.

As previously mentioned, the machine is equipped with manual and remote controls 122, which can be used from the ground level; a radio remote control unit can also be used from a distance. The platform has four controls enabling the operator to maneuver it.

I claim:

1. An improved transportable hoisting machine mounted on a pivoting platform comprising:

a twin-arm telescopic unit (B) having two telescopic rails (105 . . . 109 and 105*a* . . . 109*a*), each having telescopic elements being joined transversely and being extensible longitudinally at the same time and in the same measure by means of appropriate mechanisms, said twin arm (B) being longitudinally extensible by means of a first telescopic hydraulic cylinder (104);

a carriage (120) with a platform (119) being mounted on said twin arm telescopic unit and moved by means of steel ropes (131) connected to a first windlass (121), said carriage being equipped with four pairs of flanged, frustoconical rollers (126–127 and 128–129) on either side of said twin arm telescopic unit (B), said flages of said rollers being held against the sides of the telescopic twin arm unit by means of elastic devices (130), said rollers being supported by said carriage having a symmetrical, lateral carriage frame structure comprising a multiplicity of levers (124,125) being attached to said carriage, said levers having a pantographic type articulation, and having the purpose of maintaining the rollers against the side surfaces of said twin arm telescopic unit;

said machine also being equipped with a second windlass (201) provided with an incorporated brake having a steel rope having the purpose of locking twin arm (B) at any desired height, said first telescopic hydraulic cylinder (104) located on the pivoting platform (111) of said hoisting machine, stabilizes said twin arm telescopic unit when said carriage is loaded, said first telescopic hydraulic cylinder achieving stabilization of said twin arm telescopic unit by the pressurization of said first hydraulic cylinder after said twin arm telescopic unit has reached the desired height; and said carriage also being equipped with an automatic emergency brake and a device (237,237*a*,238, 239, 240) able to stop all hoisting machine operations if any slack is detected in steel ropes used in said machine.

2. The machine of claim 1 wherein the sequential extension and retraction of the telescopic elements (105 . . . 109 and 105*a* . . . 109*a*) is controlled by pairs of cogged wheels integral with each other, which are positioned at the top of the telescopic elements of each of the two telescopic rails, the teeth (143) of said cogged wheels meshing with corresponding notches (150) in the surface facing said wheels of the different telescopic elements.

3. The machine of claim 1 further comprising two additional telescopic cylinders;

said telescopic hydraulic cylinder (104) capable of extending said twin arm telescopic unit (B);

said two additional telescopic hydraulic cylinders being used to stabilize the angle of said twin arm telescopic unit.

4. The machine of claim 1 wherein the carriage frame comprises a transverse rotating rod (208);

a pair of knurled cams (214) at each end of said rod in correspondence with the sides of said twin arm telescopic unit on which said rollers roll;

elastic devices (209) force the knurled cams (214) against the surface on which said rollers roll;

a bracket (205) attached to said rod for anchoring the ends of said steel ropes (131) whose opposite ends are attached to said rod;

a first windlass (121) having the purpose of moving the carriage along the twin arm telescopic unit (B).

5. The machine of claim 1 wherein the adherence of the pairs of rollers (126,127,128,129) against the sides of said twin arm telescopic unit is assured by the pulling action of said steel ropes (131) and the reaction of said elastic devices (130).

6. The machine of claim 1 wherein said first windlass (121) having the purpose of moving the carriage (120) by means two of said steel ropes (131);

the second windlass driving a single steel rope (220) and thereby controlling the retraction of the twin-arm telescopic unit.

7. The machine of claim 1 further comprising sliding extensions (234) mounted on the outside of the base telescopic elements (105,105*a*) and by resting against the ground allow the carriage (120) and platform to be lowered, said extensions being brought into the resting position by the movement of said carriage, and then being hooked to said carriage and locked in place.

8. The machine of claim 1 further comprising a switch (239) capable of automatically stopping all machine operations, said switch is tripped whenever there is any slack in the steel ropes connected to said windlasses in operation.

9. The machine of claims 1, 2, 3, 4, 5, 6, 7, or 8 further comprising control means for operating said machine comprising at least one of:

manual controls;

controls on the platform;

remote control; and a radio remote control unit.

* * * * *